US008254619B2

(12) United States Patent
Yeh et al.

(10) Patent No.: US 8,254,619 B2
(45) Date of Patent: Aug. 28, 2012

(54) MICROELECTROMECHANICAL MICROPHONE CARRIER MODULE

(75) Inventors: Jen-Chuan Yeh, Changhua County (TW); Jyong-Yue Tian, Taichung County (TW); Kuo-Ting Lee, Nantou County (TW)

(73) Assignee: Lingsen Precision Industries Ltd., Taichung (TW)

( * ) Notice: Subject to any disclaimer, the term of this patent is extended or adjusted under 35 U.S.C. 154(b) by 215 days.

(21) Appl. No.: 12/855,861

(22) Filed: Aug. 13, 2010

(65) Prior Publication Data

US 2011/0293119 A1 Dec. 1, 2011

(30) Foreign Application Priority Data

May 31, 2010 (TW) ..... 99210332 U

(51) Int. Cl.
*H04R 21/02* (2006.01)

(52) U.S. Cl. ..... 381/361; 381/355; 381/360

(58) Field of Classification Search ..... 381/355, 381/360, 361

See application file for complete search history.

(56) References Cited

U.S. PATENT DOCUMENTS

| | | | | |
|---|---|---|---|---|
| 7,217,588 | B2 * | 5/2007 | Hartzell et al. | 438/51 |
| 8,169,041 | B2 * | 5/2012 | Pahl et al. | 257/416 |
| 2009/0180655 | A1 * | 7/2009 | Tien et al. | 381/361 |
| 2010/0128914 | A1 * | 5/2010 | Khenkin | 381/361 |
| 2011/0180924 | A1 * | 7/2011 | Tian et al. | 257/704 |
| 2011/0235841 | A1 * | 9/2011 | Tanaka et al. | 381/355 |
| 2011/0293119 | A1 * | 12/2011 | Yeh et al. | 381/171 |
| 2012/0008805 | A1 * | 1/2012 | Hachinohe et al. | 381/163 |

* cited by examiner

*Primary Examiner* — Ramon Barrera

(74) *Attorney, Agent, or Firm* — Browdy and Neimark, PLLC

(57) ABSTRACT

An MEM microphone carrier module is composed of a substrate and a cover plate. The substrate includes a space layer, a bottom layer, a recession recessed from a top side of the space layer, and a groove formed in the recession. The bottom layer has a metallic plate defining a predetermined pattern and exposed outside a surface thereof. The bottom layer is a single-layer structure formed by the molding of the metallic plate and the insulating glue, such that the substrate is thinner to need lower production cost and take less assembly time than the prior art.

2 Claims, 1 Drawing Sheet

MICROELECTROMECHANICAL MICROPHONE CARRIER MODULE

BACKGROUND OF THE INVENTION

1. Field of the Invention

The present invention relates generally to a microelectromechanical (MEM) microphone, and more particularly, to an MEM microphone carrier module.

2. Description of the Related Art

Compared with a conventional microphone, an MEM microphone includes the advantages of low interference, small size, and power saving. More and more electronic products are designed to be very compact subject to the dominant trend thereof, so the MEM microphone is taking place of the conventional microphone.

When it is intended to package the conventional MEM microphone, mostly, a multi-layer or composite substrate is used for carrying a chip. However, such multi-layer or composite substrate is high in production cost and thick in structure, such that the size of the conventional MEM microphone after packaged is increased.

In addition, the package of the MEM microphone needs a passage for sound transmission to allow the external sound to be transmitted to the chip located internally. As a result, a conventional MEM microphone carrier module includes a space member mounted between a chip carrier and a chip and having a passage adapted for sound transmission in such a way that the sound can be transmitted to the chip through the passage. However, in the process of the packaging, it takes more time to mount and position the space member onto the chip carrier. Therefore, such conventional MEM microphone carrier module still needs further improvement.

SUMMARY OF THE INVENTION

The primary objective of the present invention is to provide an MEM microphone carrier module, which can decrease the size of its package, need lower production cost, and take less assembly time.

The foregoing objective of the present invention is attained by the MEM microphone carrier module composed of a substrate and a cover plate. The substrate includes a space layer, a bottom layer, a recession recessed from a top side of the space layer, and a groove formed in the recession. The bottom layer has a metallic plate defining a predetermined pattern and exposed outside a surface thereof. The cover plate is mounted in the recession and includes a reception hole and a transmission hole both corresponding to two ends of the groove respectively.

In a preferred embodiment of the present invention, the top side of the cover plate is flush with that of the space layer.

DETAILED DESCRIPTION OF PREFERRED EMBODIMENTS

Figure 1:
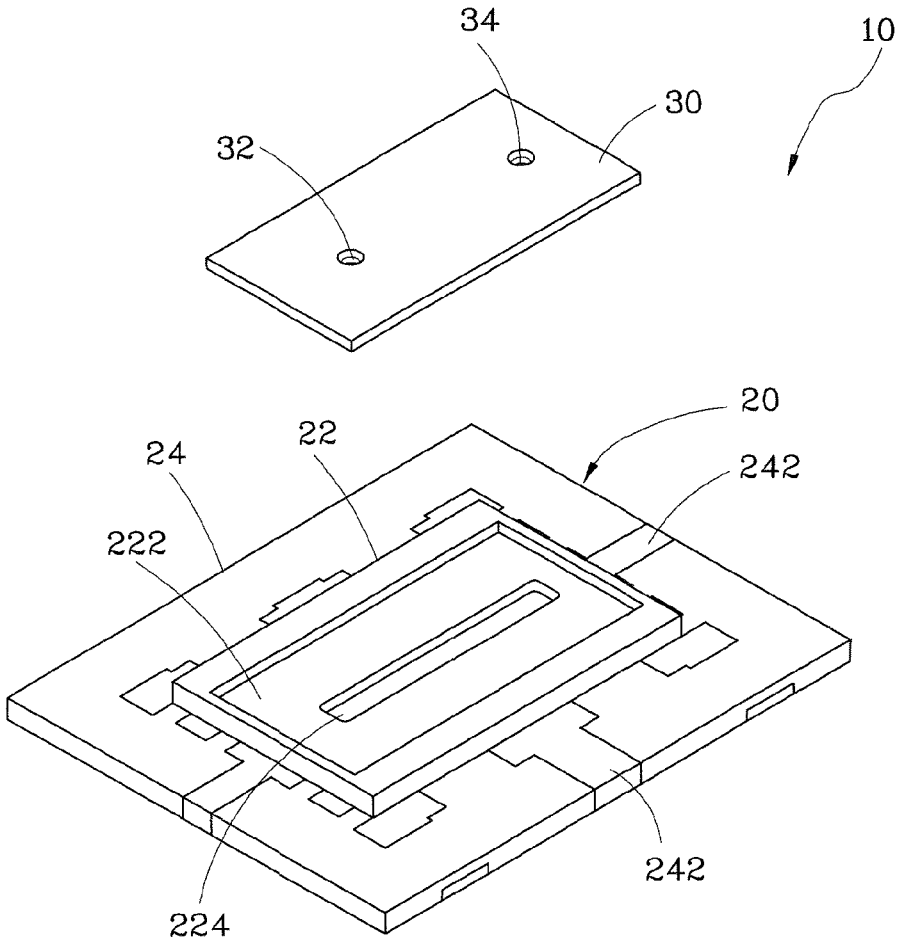
FIG. 1 is an exploded view of a first preferred embodiment of the present invention.

Referring to FIG. 1, an MEM microphone carrier module 10 constructed according to a first preferred embodiment of the present invention is composed of a substrate 20 and a cover plate 30. The detailed descriptions and operations of these elements as well as their interrelation are recited in the respective paragraphs as follows.

The substrate 20 is includes a space layer 22 and a bottom layer 24 which are integrally formed by pre-molding.

The area of the space layer 22 is smaller than that of the bottom layer 24 and located at a center of a top side of the bottom layer 24. A rectangular recession 222 is recessed from a top side of the space layer 22 for facilitating mounting and positioning the cover plate 30 onto the substrate 20. A groove 224 is formed in the recession 222.

The bottom layer 24 is a square plate and includes a metallic plate 242. The metallic plate 242 defines a predetermined pattern on a surface of the bottom layer 24.

In addition, the substrate 20 is manufactured according to the following steps. First, apply a half-etching process to an upper surface of the metallic plate 242 according to a predetermined pattern; put the metallic plate 242 in a mold having the space layer 22 and the bottom layer 24, then infuse an insulating glue, and carry out a molding process; finally, apply another half-etching process, infusion of the insulating glue, and molding process to a lower surface of the metallic plate 242. In other words, the bottom layer 24 is formed by that the insulating glue is molded to the metallic plate 242, and the space layer 22 is formed by the insulating glue on the bottom layer 24 as the molding process proceeds.

The cover plate 30 is mounted in the recession 222 and a top side of the cover plate 30 is substantially flush with that of the space layer 22. The cover plate further includes a reception hole 32 and a transmission hole 34 both corresponding to two ends of the groove 224 separately.

Figure 2:
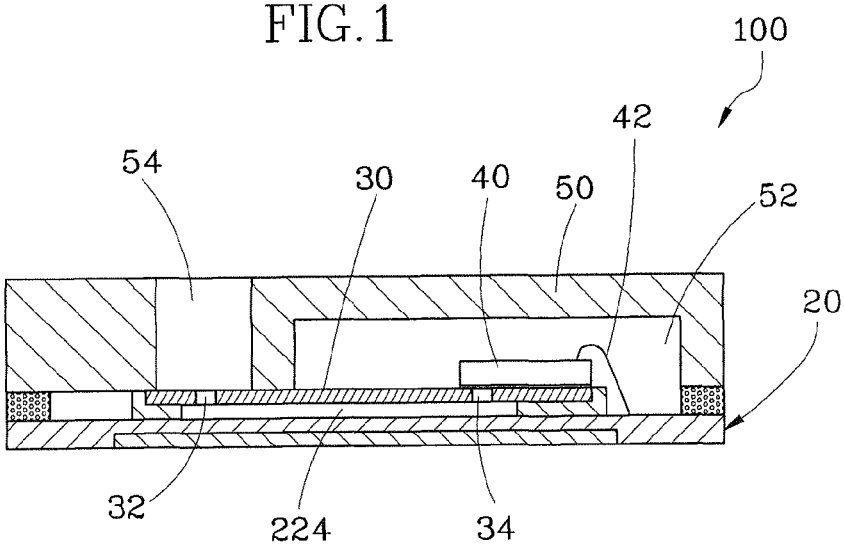
FIG. 2 is a sectional view of a second preferred embodiment of the present invention.

Referring to FIG. 2, an MEM microphone package 100 constructed according to a second preferred embodiment of the present invention is composed of a substrate 20, a cover plate 30, a chip 40, and a sealing cover 50. The detailed descriptions and operations of these elements as well as their interrelation are recited in the respective paragraphs as follows.

Because the features of and interrelation between the substrate 20 and the cover plate 30 are identical to those of the first embodiment, their recitation is skipped.

The chip 40 is mounted to the cover plate 30 and located above the transmission hole 34. The chip 40 and the metallic plate 242 are electrically connected by a bonding wire 42.

The sealing cover 50 is mounted on the substrate 20 and includes a chamber 52 and a passage 54, as shown in FIG. 2. The chip 40 is received in the chamber 52. The reception hole 32 communicates with the passage 54.

In light of the above structure, a passage of audio transmission is formed to allow the external sound to be transmitted through the passage 54, the reception hole 32, the groove 224, and the transmission hole 34 in turn to the chip 40. Next, the chip 40 converts it into an electronic signal and then sends it out. Because the bottom layer 24 is a single-layer structure formed by the molding of the metallic layer 242 and the insulating glue, the substrate 20 of the present invention is thinner in structure and lower in production cost than the conventional composite or multi-layer substrate. Besides, the recession 222 is formed at the top side of the space layer 222 to allow the cover plate 30 to facilitate mounting and positioning the cover plate 30 onto the substrate 20, such that the whole assembly time can be effectively reduced to provide higher production efficiency.

Although the present invention has been described with respect to specific preferred embodiments thereof, it is in no way limited to the specifics of the illustrated structures but changes and modifications may be made within the scope of the appended claims.

What is claimed is:

1. An MEM microphone carrier module comprising:

a substrate having a space layer, a bottom layer, a recession recessed from a top side of the space layer, and a groove formed in the recession, the bottom layer having a metallic plate defining a predetermined pattern and exposed outside a surface of the bottom layer; and a cover plate mounted in the recession and having a reception hole and a transmission hole both corresponding to two ends of the groove respectively.

2. The MEM microphone carrier module as defined in claim 1, wherein the cover plate comprises a top side flush with that of the space layer.

* * * * *